US005616386A

United States Patent [19]

Okada et al.

[11] Patent Number: 5,616,386

[45] Date of Patent: Apr. 1, 1997

[54] CLEANING SHEET FOR A PAPER FEEDING DEVICE

[75] Inventors: Tomohiko Okada, Yamatokooriyama; Fumio Shiozaki, Tenri; Toshio Takehara, Nabari; Seiichi Kizu; Kazuhiko Ashiya, both of Yamatokooriyama, all of Japan

[73] Assignee: Sharp Kabushiki Kaisha, Osaka, Japan

[21] Appl. No.: 576,856

[22] Filed: Dec. 22, 1995

Related U.S. Application Data

[63] Continuation of Ser. No. 180,389, Jan. 12, 1994, abandoned.

[30] Foreign Application Priority Data

Feb. 19, 1993 [JP] Japan ..... 5-055169

[51] Int. Cl.[6] ..... G03G 21/00

[52] U.S. Cl. ..... 428/40.1; 15/256.51; 51/293; 51/297; 51/309; 428/40.2; 428/41.7; 428/41.8; 428/42.2; 428/43; 428/192; 428/194; 428/214; 428/323; 399/343

[58] Field of Search ..... 428/40.1, 40.2, 428/41.7, 41.8, 42.2, 43, 137, 192, 194, 214, 323; 51/293, 309, 297; 15/256, 51; 355/283, 296

[56] References Cited

U.S. PATENT DOCUMENTS

| | | | |
|---|---|---|---|
| 4,843,436 | 6/1989 | Evangelista | 355/133 |
| 5,138,390 | 8/1992 | Miyabayashi | 355/283 |
| 5,201,976 | 4/1993 | Eastin | 428/41 |

FOREIGN PATENT DOCUMENTS

| | | |
|---|---|---|
| 58-82287 | 5/1983 | Japan . |
| 354588 | 3/1991 | Japan . |

*Primary Examiner*—Nasser Ahmad

*Attorney, Agent, or Firm*—Birch, Stewart, Kolasch & Birch, LLP

[57] ABSTRACT

The present invention is intended to provide a cleaning sheet which is easy to handle and effective to clean a picker roller. A cleaning sheet coated with a cleaning adhesive is placed in a paper feeding cassette. A picker roller rotates thereby being cleaned with the cleaning sheet. The sheet has a certain stiffness so as not to disengage from a claw of the cassette when the picker roller rotates. The sheet is composed of a base sheet with a coat of cleaning adhesive and a releasable cover sheet. The base sheet and the releasable cover sheet are cut off by specified portions allowing for the multiple use of the sheet. A higher cleaning effect is obtained by using an adhesive containing abrasive grains as a cleaning adhesive applied onto the cleaning sheet.

6 Claims, 4 Drawing Sheets

CLEANING SHEET FOR A PAPER FEEDING DEVICE

This application is a continuation of application Ser. No. 08/180,389 filed on Jan. 12, 1994, now abandoned.

BACKGROUND OF THE INVENTION

1. Field of the Invention

The present invention relates to a cleaning sheet for a paper feeding device and, more particularly, to a cleaning sheet having a certain stiffness and coated with a cleaning adhesive (or an adhesive containing abrasive grain), which is set in a paper cassette to effectively clean a picker (paper feeding) roller when the roller rotates in contact with the cleaning paper.

2. Description of Related Art

The conventional cleaning sheet for feeding rollers in a printer or a copying machine is comprised of a thin sheet of paper with a coat of weak adhesive and covered with a releasable paper. The cleaning sheet, after removing the releasable paper therefrom, is placed in the paper cassette in the same way as the paper to be printed and is transported through a passage thereby cleaning the rollers.

As described above, the conventional cleaning sheet may not effectively clean a paper feeding roller. If the adhesive power of the sheet is increased, problems may occur such as jamming, damage to the ribbon, dead feeding etc. The conventional cleaning sheet has such drawbacks as it can be used only once and may not be automatically set to clean the roller.

The Japanese publication of the unexamined application No. JP, A, 58-82287 describes a conventional cleaning sheet for cleaning rollers which has a cleaning portion made of base paper having at least one side coated with an adhesive and a non-adhesive leading-paper portion which is continuous to the cleaning portion. The adhesive-coated portion of the cleaning sheet is covered with a releasable sheet of paper having a plurality of slits at specified intervals of width from one end to, at least, the center portion thereof.

The Japanese publication of the unexamined application No. JP, A, 3-54588 discloses another conventional cleaning sheet that is coated with a semi-adhesive coat and that may pass through rollers placed opposite to each other.

The Japanese publication of the unexamined application No. JP, U, 62-91671 discloses another conventional cleaning roller whereon a cleaning sheet, having perforations in it crosswise, is wound at least twice.

The Japanese publication of the unexamined application No. JP, U, 2-128155 discloses still another conventional cleaning sheet having both sides coated with an adhesive and covered with a releasable sheet of paper which can be fed from a manual feeding tray for cleaning passages for paper sheets.

The present invention relates to a cleaning sheet which is composed of a base sheet having enough stiffness not to protrude from a paper feeding cassette, a layer of cleaning adhesive applied to the base sheet and a releasable cover sheet laid on the adhesive layer, and the releasable cover sheet has a weak adhesive at its back end adhering to the reverse side of the last sheets of paper in the cassette and a strong adhesive at its front end adhering to the layer of cleaning adhesive on the base sheet.

SUMMARY OF THE INVENTION

It is an object of the present invention to provide a cleaning sheet for a paper feeding device which is easy to handle and which has the increased effect of cleaning a picker roller having the most important role of feeding sheets of paper into a printer.

It is another object of the present invention to provide a cleaning sheet for a paper feeding device which has such a stiffness and roughness that it will not protrude from the paper feeding cassette. Therefore, problems such as jamming, breaking of ribbons, dead feeding etc. will not occur. It is also possible to increase the adhesive power of the cleaning sheet i.e. to obtain an increased efficiency in cleaning the paper feeding roller.

It is another object of the present invention to provide a cleaning sheet for a paper feeding device which has perforations for the separation of its portions at a specified interval. Therefore, it may be used several times, successively peeling releasable cover sheets from the usable adhesive portion, i.e., preventing the remaining adhesive portions from becoming dry.

It is another object of the present invention to provide a cleaning sheet for a paper feeding device which may be used as a cleaning adhesive to improve the effect of the cleaning.

It is another object of the present invention to provide a cleaning sheet for a paper feeding device which can automatically be prepared to clean the picker roller by peeling its releasable cover sheet together with the last paper sheet when the latter is fed from a paper feeding cassette to a printer. Periodical cleaning of the picker roller may be programmed in such a way that its cycle starts when a specially provided sensor detects the exposed cleaning sheet.

It is another object of the present invention to provide a cleaning sheet for a paper feeding device which is stiff enough so as not to protrude from the paper feeding cassette thereby allowing the picker roller to make multiple revolutions in contact with the cleaning sheet, i.e., to be cleaned more effectively.

A cleaning sheet for cleaning a picker roller consists of a sheet member having a certain stiffness, a layer of cleaning adhesive and a releasable cover sheet. The base sheet and the releasable cover sheet are perforated to be uncovered by a size necessary for cleaning the picker roller and then to be cut off by the used part. The cleaning adhesive contains abrasive grains. In addition, the released cover sheet has a rear edge coated with week adhesive for adhering to the reverse side of the last printing paper to be fed and a front edge coated with a strong adhesive for adhering to a layer of the cleaning adhesive on the base sheet. A thus constructed and usable cleaning sheet can offer an improved effect of cleaning the picker roller.

To achieve the above-mentioned purposes, the present invention provides a cleaning sheet for use in a paper feeding device, which is characterized in that (1) the cleaning sheet is composed of a base sheet having a certain stiffness so as not to protrude from a feeding cassette during the rotating of the picker (paper feeding) roller, a layer of cleaning adhesive applied onto the sheet member and a releasable cover sheet laid on the adhesive layer;

(2) the base sheet and the releasable cover sheet have perforations allowing the cleaning sheet to be uncovered by a size necessary for cleaning the picker roller and thereby to be used several times;

(3) in addition to item 1 or 2, the adhesive contains abrasive grains; and (4) in addition to item 1, the releasable cover sheet has its rear edge coated with a weak adhesive for adhering to the reverse side of the last printing sheet of paper and its front edge coated with a strong adhesive for adhering to a layer of the cleaning adhesive on the sheet of paper member.

PREFERRED EMBODIMENT OF THE INVENTION

Figure 1A:
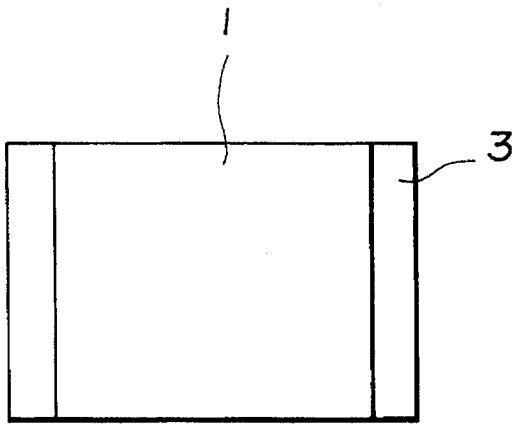
FIG.1A (CONVENTIONAL ART)
FIGS. 1A and 1B are a view showing a conventional cleaning sheet.
Figure 1B:
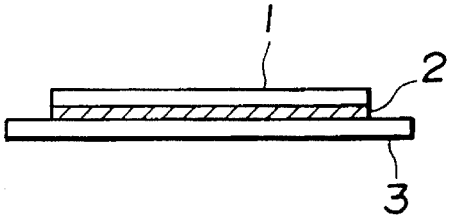
FIG.1B (CONVENTIONAL ART)

FIGS. 1A and 1B show a conventional cleaning sheet. There is shown a sheet of releasable paper 1, weak adhesive 2 and a sheet of thin paper 3.

The conventional cleaning sheet for feeding rollers in a printer or a copying machine consists of a thin sheet of paper 3 having a coat of weak adhesive 2 and covered with a releasable sheet of paper 1. The cleaning sheet after removing a releasable sheet therefrom is placed in a paper cassette in the same way as paper to be printed and is transported through a passage thereby cleaning the rollers.

As described above, the conventional cleaning sheet may not effectively clean a paper feeding roller. If the adhesive power of the sheet is increased, problems may occur such as jamming, damage to ribbons, dead feeding etc. The conventional cleaning sheet involves such drawbacks as that it can only be used once and it may not be automatically set to clean the roller.

Figure 2:
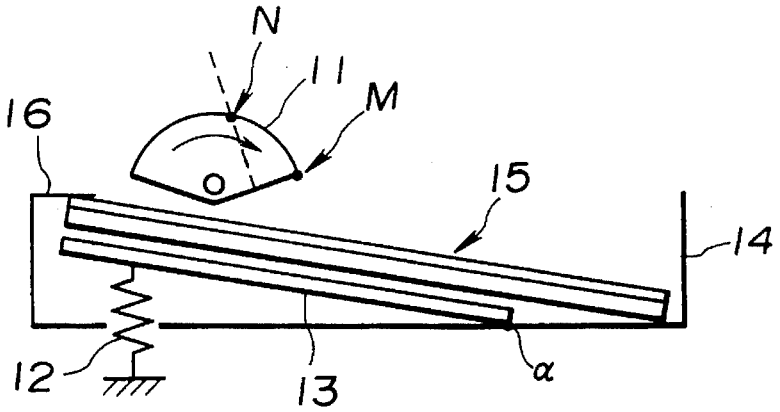
FIG. 2 is a construction view for explaining an example of a cleaning sheet for a paper feeding device, according to the present invention.

Referring now to the accompanying drawings, the preferred embodiments of the present invention will be described in detail as follows:

FIG. 2 is a construction view for explaining an example of a cleaning sheet for a paper feeding device, according to the present invention. There are shown a picker roller 11, a supporting spring 12, a rotary plate 13 having a fulcrum α, a paper feeding cassette 14, a cleaning sheet 15 for a picker roller (the top side of the sheet is coated with a cleaning adhesive) and a claw 16. The cleaning sheet 15 with a coat of cleaning adhesive is placed in the paper feeding cassette 14. The picker roller 11 rotates thus being cleaned with the cleaning sheet. To avoid jamming of the cleaning sheet during the rotation of the picker roller, its base sheet is made of thick paper having a certain stiffness so as not to disengage itself from the claw 16 of the cassette 14.

Figure 3A:
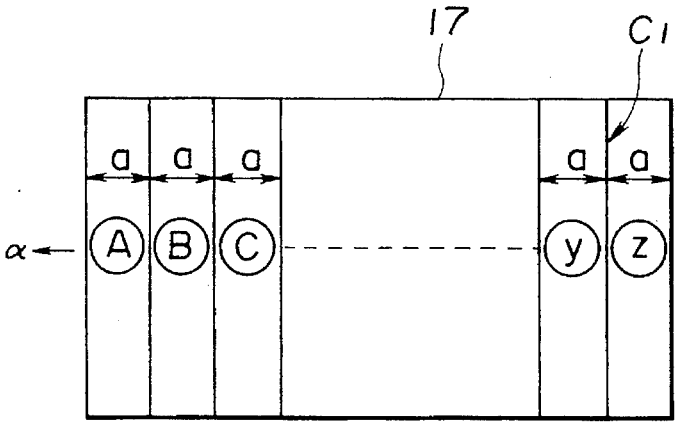
FIGS. 3A, 3B and 3C are a view showing an example of the construction of a cleaning sheet shown in FIG. 2.
Figure 3B:
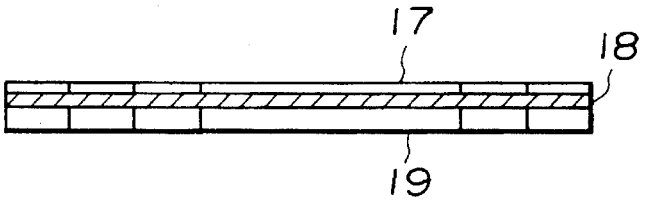
Figure 3C:
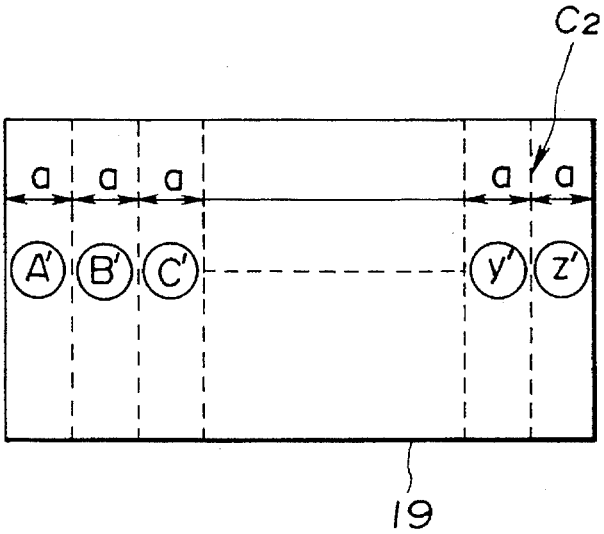

FIGS. 3A to 3C are a construction view of a cleaning sheet. FIG. 3A is a plane view, FIG. 3B is a sectional view and FIG. 3C is a bottom view of the cleaning sheet. In the drawings, numeral 17 designates a releasable cover sheet 17, numeral 18 designates a layer of cleaning adhesive or adhesive containing abrasive grains and numeral 19 designates a base sheet. $C_1$ as shown in FIG. 3A, designates a completely cut off portion or perforation on the releasable cover sheet 17, and $C_2$ as shown in FIG. 3C, designates perforations in the base sheet 19 so as to be easily separated from the remainder of the base sheet 19.

The cleaning sheet 15 can be used several times since its releasable cover sheet 17 is completely separated (or perforated) at a specified interval of size "a" necessary for cleaning the picker roller and a base sheet 19 is perforated to be easily separated by the same interval "a". The cleaning sheet is used as follows: A portion A of the releasable cover sheet 17 is first removed for "first time" cleaning, then a portion A' of the base sheet 19 and a portion B of the releasable cover sheet 17 are removed for second time cleaning. Subsequent cleaning is conducted by removing the subsequent portions of the base sheet 9 and the releasable cover sheet 17. This method makes it possible to remove a portion of the releasable cover sheet from a usable cleaning portion of the base sheet just before cleaning the picker roller, thereby keeping the cleaning adhesive from becoming dry. An adhesive containing abrasive grains can be used instead of the usual adhesive depending upon the degree of dirt or material on the picker roller in order to attain an increased cleaning effect.

Figure 4A:
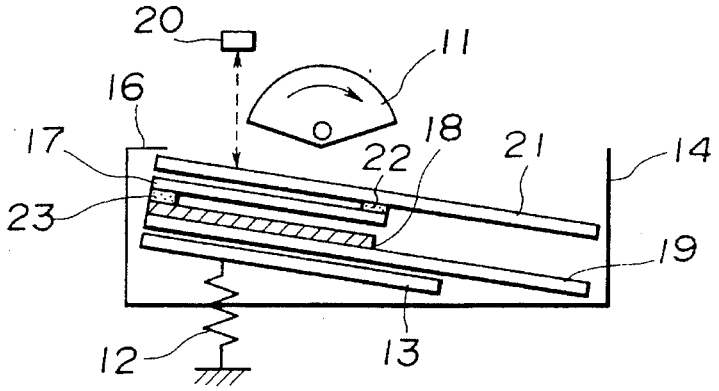
FIGS. 4A, 4B and 4C illustrate how to automatically prepare a cleaning sheet for use (to automatically perform periodic cleaning) of a picker roller with a cleaning sheet, according to the present invention.
Figure 4B:
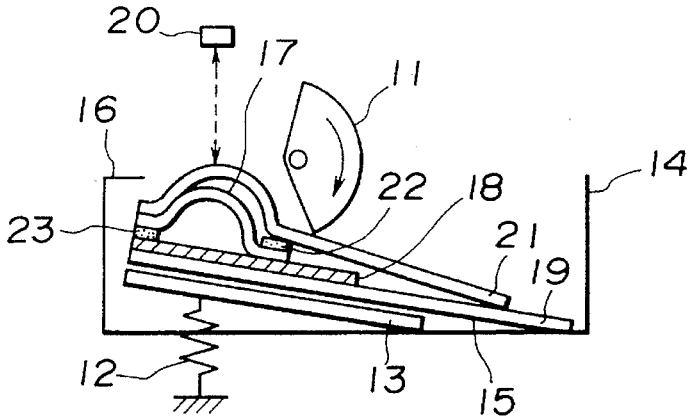
Figure 4C:
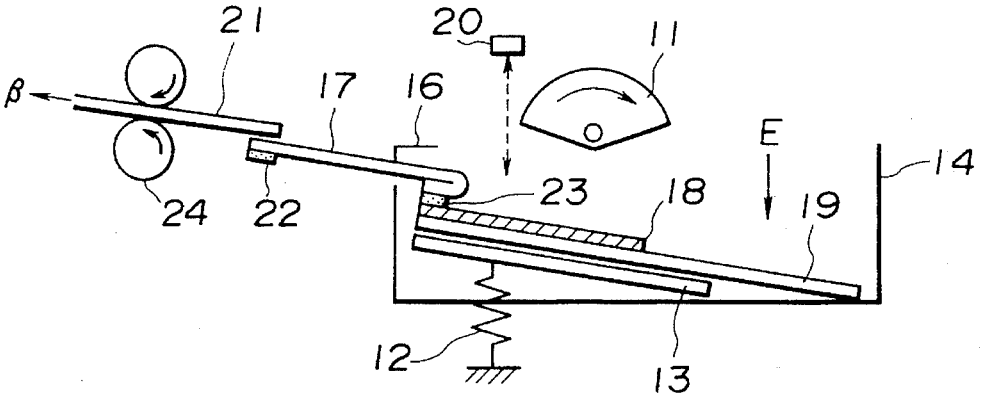
Figure 5:
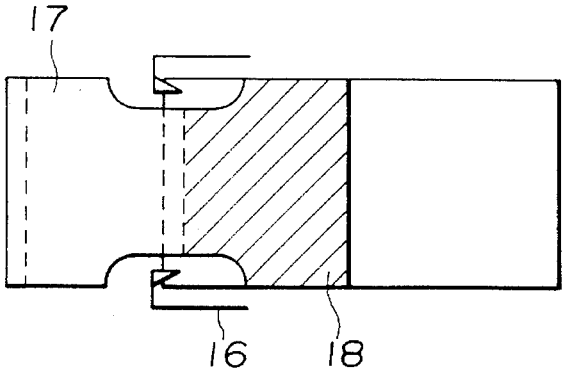
FIG. 5 is a view in the direction of the arrow E in FIG. 4C.

FIGS. 4A to 4C illustrate how to automatically conduct the cleaning of a picker roller at regular intervals (e.g., 1 cycle of cleaning after feeding 100 sheets of paper) by using a cleaning sheet. FIG. 5 is a view in the direction of the arrow E in FIG. 4C. There are shown a sensor 20, a last sheet of paper 21 to be fed for printing or copying, a layer of weak adhesive 22, a layer of strong adhesive or stapled portion 23 and carrier rollers 24.

A cleaning sheet 15 is placed at the bottom of a pile of paper sheets in a paper feeding cassette in such a manner that its releasable cover sheet 17 is attached with a weak adhesive to the reverse side of a last paper sheet 21 in a pile. When the last paper sheet 21 is fed by the picker roller 11, the releasable cover sheet 17 is peeled off to the front end portion as shown in FIG. 4B and then it separates from the last paper sheet 21 because the front end of the releasable cover sheet is attached with a strong adhesive 23 or is stapled to the front end of a base sheet 19. The paper sheet 21 is fed in the direction β shown in FIG. 4C to a printer or a copying machine (not shown) wherein it is printed and then delivered out therefrom. At this time, the sensor 20 disposed as shown in FIGS. 4A, 4B and 4C may detect the cleaning sheet 15 with the cover sheet removed 17 to start the cleaning of the picker roller 11.

Figure 6:
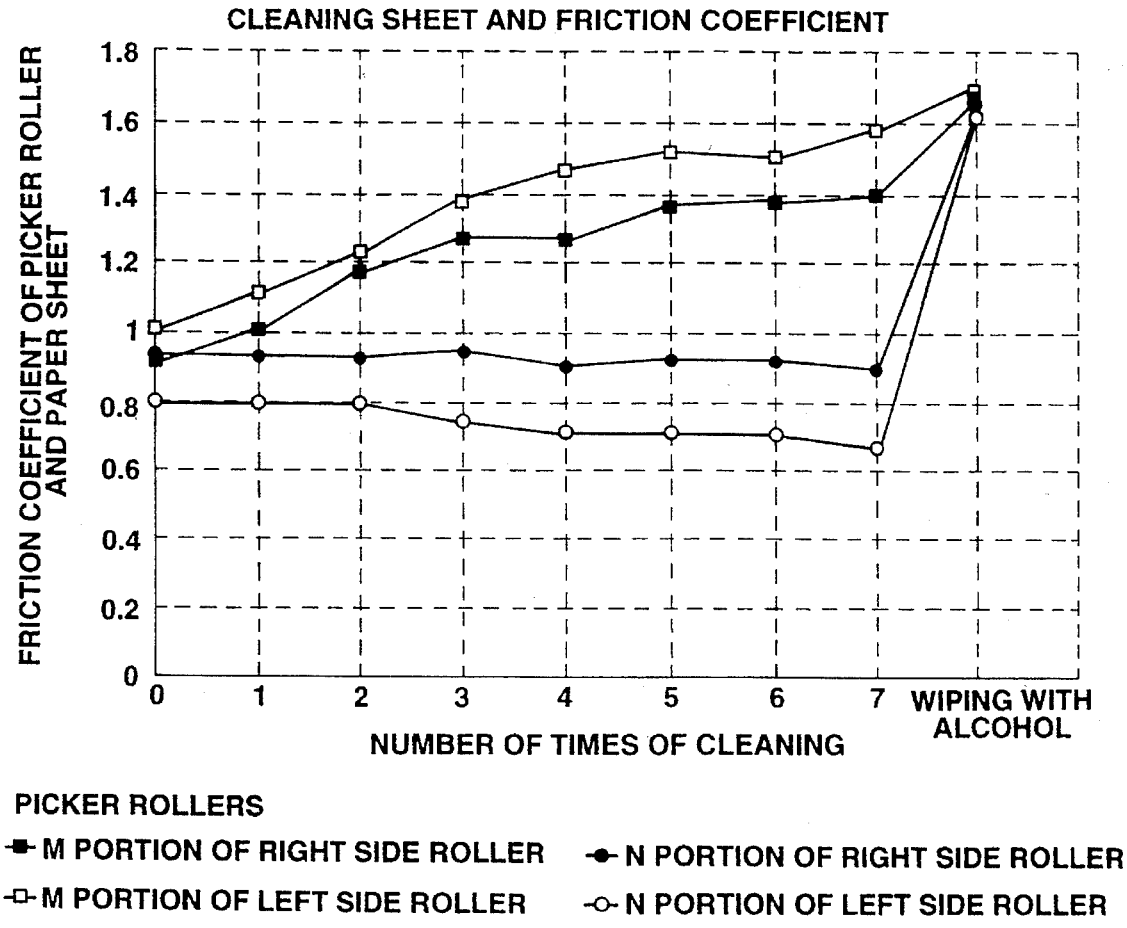
FIG. 6 is a diagram showing the degree of improved friction coefficiency of a picker roller and a sheet of printing paper depending on the number of revolutions of the picker roller when a cleaning sheet of paper is used for cleaning the roller.

FIG. 6 shows a degree of improvement in the friction coefficiency of a picker roller against a sheet of paper (for xerographic printing) depending upon the rates of rotation of the picker roller. In FIG. 6, M is an intersection of the right-side of the arc portion with a straight line portion of the picker roller shown in FIG. 2, and N is the intersection of the perpendicular from the center point on the straight line portion with the arc portion of the picker roller.

In the experiments conducted for obtaining the diagram of FIG. 6, two pieces of picker rollers were used: one is described as the right-side picker roller and the other is described as the left-side picker roller. The picker roller shown in FIG. 2 corresponds to the left-side roller. In the shown case, a cycle of cleaning the picker roller is comprised of 7 revolutions of the roller in contact with the cleaning sheet with subsequent wiping with a piece of cloth moistened with alcohol. However, at a cleaning cycle of more than 7 revolutions the same characteristic can be obtained. The similar characteristics are obtained not only in the case when the picker roller is cleaned by 7 revolutions each with fresh adhesive by subsequently peeling off releasable cover portions of width "a" of the cleaning sheet (in FIGS. 3A and 3C) but also in the case when the roller is cleaned by 7 revolutions on the same adhesive of the cleaning sheet.

We claim:

1. A cleaning sheet for a paper feeding device including a cassette member having a claw formed thereon for maintaining copy paper within the cassette, said cleaning sheet comprising:

a base sheet;

a layer of cleaning adhesive coated on said base sheet; and a releasable cover sheet laid on said layer of cleaning adhesive, said base sheet having a stiffness so as to maintain engagement with the claw of the cassette member and allowing only the releasable cover sheet to be discharged from the cassette member upon exhaustion of copy paper from the cassette member, wherein only said base sheet and said releasable cover sheet are perforated in a superposed relationship so that the cleaning sheet may be used plural times by peeling off a perforated section of the releasable cover sheet exclusive of said layer of cleaning adhesive and said base sheet by a size necessary for cleaning a picker roller and subsequently cutting off a used part of the base sheet including the layer of cleaning adhesive thereon.

2. The cleaning sheet according to claim 1, wherein the cleaning adhesive contains abrasive grains.

3. The cleaning sheet according to claim 1, wherein said releasable cover sheet includes a first major surface facing said base sheet and a second major surface opposing the first major surface;

a second adhesive coated on at least a portion of the second major surface of said releasable cover sheet and in contact with a reverse side of an original sheet of paper;

a third adhesive coated on at least a portion of the first major surface of said releasable cover sheet and in contact with said layer of cleaning adhesive, said third adhesive having a greater adhesion than said second adhesive, wherein advancement of the sheet of paper peels said releasable cover sheet away from said layer of cleaning adhesive to a position not exceeding said third adhesive.

4. A cleaning sheet for a paper feeding device, said cleaning sheet comprising:

a base sheet;

a layer of cleaning adhesive coated on said base sheet; and a releasable cover sheet laid on said layer of cleaning adhesive, wherein said releasable cover sheet includes a first major surface facing said base sheet and a second major surface opposing the first major surface;

a second adhesive coated on at least a portion of the second major surface of said releasable cover sheet and in contact with a reverse side of an original sheet of paper;

a third adhesive coated on at least a portion of the first major surface of said releasable cover sheet and in contact with said layer of cleaning adhesive, said third adhesive having a greater adhesion than said second adhesive, wherein advancement of the sheet of paper peels said releasable cover sheet away from said layer of cleaning adhesive to a position not exceeding said third adhesive.

5. The cleaning sheet according to claim 4, wherein only said base sheet and said releasable cover sheet are perforated so that the cleaning sheet may be used plural times by peeling off a perforated section of the releasable cover sheet by a size necessary for cleaning the picker roller and cutting off a used part of said base sheet.

6. The cleaning sheet according to claim 4, wherein the cleaning adhesive contains abrasive grains.

* * * * *